US007779520B2

(12) United States Patent
Johnson, Sr.

(10) Patent No.: US 7,779,520 B2
(45) Date of Patent: Aug. 24, 2010

(54) STRUCTURES FOR CONNECTING CREMATION ASHES WITH LIVING BEINGS

(76) Inventor: Raymond Keith Johnson, Sr., P.O. Box 449, Barre, VT (US) 05641

( * ) Notice: Subject to any disclaimer, the term of this patent is extended or adjusted under 35 U.S.C. 154(b) by 0 days.

(21) Appl. No.: 12/290,513

(22) Filed: Oct. 31, 2008

(65) Prior Publication Data

US 2009/0089988 A1 Apr. 9, 2009

Related U.S. Application Data

(62) Division of application No. 11/827,412, filed on Jul. 11, 2007, now Pat. No. 7,467,444.

(51) Int. Cl.
*A61G 17/00* (2006.01)

(52) U.S. Cl. ..... 27/1; 52/133; 52/136

(58) Field of Classification Search ..... 27/1, 27/35; D99/5; 52/133, 134, 136; 63/1.14, 63/3, 3.1, 36; 40/124.5
See application file for complete search history.

(56) References Cited

U.S. PATENT DOCUMENTS

| | | | | |
|---|---|---|---|---|
| 4,977,652 | A | 12/1990 | Graham | |
| 5,158,174 | A | 10/1992 | Hereford | 206/37 |
| 5,208,957 | A | 5/1993 | Hereford | 27/1 |
| 5,379,499 | A * | 1/1995 | Jackson | 27/1 |
| 5,564,260 | A * | 10/1996 | West et al. | 53/434 |
| 5,704,103 | A * | 1/1998 | Crowley et al. | 27/1 |
| 5,755,116 | A | 5/1998 | Sparacino et al. | 63/3 |
| 5,815,897 | A | 10/1998 | Longstreth | |
| 5,832,575 | A | 11/1998 | Sturino | 27/1 |
| 5,950,287 | A | 9/1999 | Caccoatpre et al. | 27/1 |
| 6,006,458 | A | 12/1999 | Weiss | |
| 6,088,973 | A * | 7/2000 | Weiss | 52/105 |
| 6,175,995 | B1 | 1/2001 | Parker et al. | |
| 6,295,705 | B1 | 10/2001 | Gersten | 27/1 |
| 6,421,890 | B1 | 7/2002 | Biggar | 27/1 |
| 6,520,606 | B1 | 2/2003 | Robinson | 312/111 |
| 6,785,939 | B1 * | 9/2004 | James | 27/1 |
| 6,944,921 | B1 | 9/2005 | Gersten | 27/1 |
| 7,036,195 | B2 | 5/2006 | Glass | 27/1 |
| 7,043,803 | B2 * | 5/2006 | Chen | 27/1 |
| 7,174,611 | B1 * | 2/2007 | Rose et al. | 27/1 |
| 7,467,444 | B1 * | 12/2008 | Johnson, Sr. | 27/1 |
| 7,610,663 | B2 * | 11/2009 | Johnson, Sr. | 27/1 |
| 2003/0066172 | A1 | 4/2003 | Parker | |
| 2003/0221300 | A1 * | 12/2003 | Caven | 27/1 |
| 2007/0084027 | A1 * | 4/2007 | Walczak | 27/1 |
| 2008/0060176 | A1 * | 3/2008 | Kopicki | 27/1 |
| 2010/0005835 | A1 * | 1/2010 | Johnson et al. | 63/36 |

* cited by examiner

*Primary Examiner*—William L. Miller
(74) *Attorney, Agent, or Firm*—Thomas G. Ference

(57) ABSTRACT

A structure for connecting cremation ashes comprising a first vessel, a second vessel, first cremated remains, second cremated remains and a link. The first vessel holds the first cremated remains. The second vessel holds the second cremated remains. The link connects the first and second cremated remains. The link further connects the cremated remains to a living being when contact is made by the living being to the link. The structure is meant to provide a way for living beings to connect physically and spiritually with deceased loved ones.

16 Claims, 11 Drawing Sheets

STRUCTURES FOR CONNECTING CREMATION ASHES WITH LIVING BEINGS

RELATED APPLICATIONS

This application is a division of U.S. patent application Ser. No. 11/827,412 U.S. Pat. No. 7,467,444, filed Jul. 11, 2007, hereby incorporated by reference.

FIELD OF THE INVENTION

This invention relates generally to structures for preserving and memorializing the remains of humans and animals. In particular, the present invention is directed to structures for facilitating the connection of ash remains with living beings.

BACKGROUND OF THE INVENTION

The popularity of cremation is growing within modern society as an alternative to preserving bodies and burying them in coffins. Cremation is also becoming a popular method of dealing with pet remains. Cremation is usually less expensive and more ecological than burial. It also offers living individuals an opportunity to keep some of the deceased's ashes close to them to help facilitate a spiritual connection with the deceased. Although prior art structures such as urns exist for holding cremated ashes, none provide for an intimate way to connect the ash remains with the living.

SUMMARY OF THE INVENTION

One aspect of the present invention is directed to a structure for connecting cremated remains comprising a first vessel, a second vessel, first cremated remains, second cremated remains and a link. The first vessel holds the first cremated remains. The second vessel holds the second cremated remains. The link connects the first cremated remains with the second cremated remains.

Another aspect is directed to a structure for connecting cremated remains comprising a link and a vessel containing cremated remains. The link passes through the vessel. The link is for connecting with a living being.

Yet another aspect is directed to a structure for connecting cremated remains comprising a link and a plurality of vessels containing cremated remains. Each vessel is disposed along the link. The link connects all cremated remains.

Still another aspect is directed to a structure for connecting cremated remains comprising a vessel, cremated remains and a link. The vessel holds the cremated remains. The link extends into the vessel. The link has sufficient flexibility that it cannot support the vessel when the vessel is above the link.

Still yet another aspect is directed to a structure for connecting cremated remains comprising a vessel containing cremated remains and a link, wherein the link is in contact with the remains and a portion of the link lies along an outer surface of the vessel.

BRIEF DESCRIPTION OF DRAWINGS

The foregoing and other aspects and advantages of the invention will be apparent from the following detailed description of the invention, as illustrated in the accompanying drawings, in which.

DETAILED DESCRIPTION OF THE INVENTION

Figure 1A:
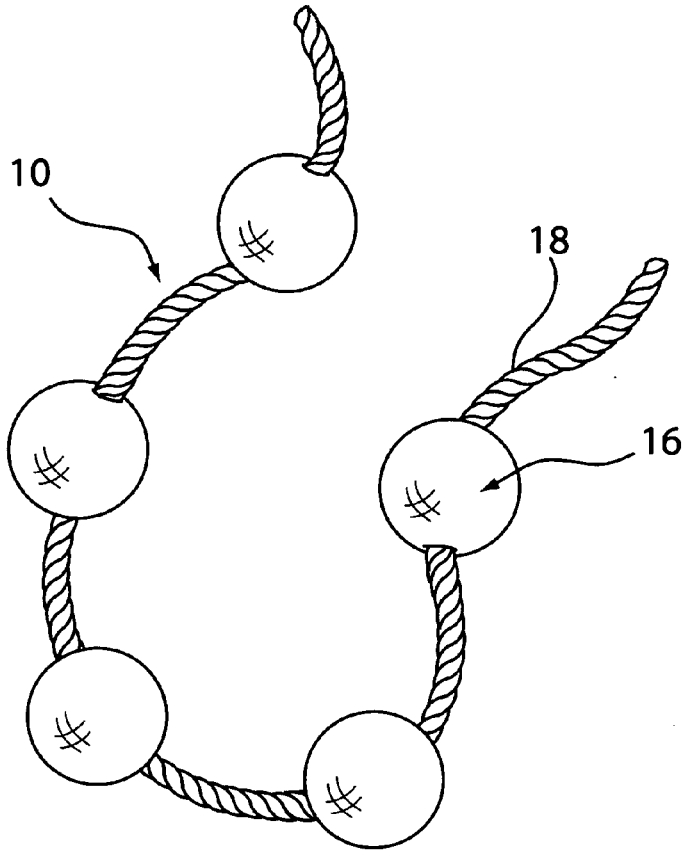
FIG. 1*a* is a perspective view of a structure according the present invention wherein two or more vessels containing cremation ashes are connected together by a link.
Figure 1B:
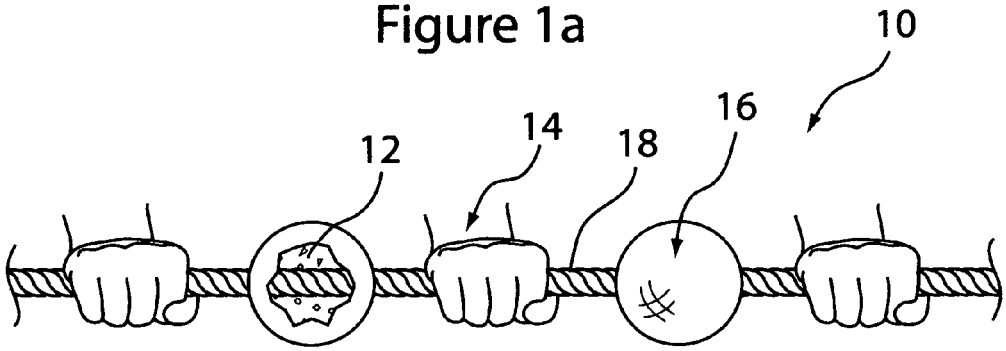
FIG. 1*b* is a cut away, perspective view of the structure in FIG. 1*a* used as a prayer rope with several living individuals placing their hands on the link to make a physical and spiritual connection to the cremated ash remains of several deceased individuals.

FIGS. 1*a* and 1*b* illustrate a connecting structure 10 for facilitating the connection of cremated remains 12 (a.k.a., cremation ashes, ash remains, or remains) with a living being 14. Cremation remains 12 may be that of a human or a pet. Connecting structure 10 may take the form of a prayer rope, a string of beads, bracelet, etc. Connecting structure 10 comprises a vessel 16 and a link 18. Vessel 16 is disposed along link 18. Connecting structure 10 may include a plurality of vessels 16 disposed along link 18. A physical and spiritual connection is made with cremated remains 12 when a living being 14 makes contact with link 18.

Each vessel 16 is prepared to contain cremated remains 12. Preparation and filling of vessel 16 with cremated remains 12 may occur at a crematorium or an individual may fill the vessel with ash remains they already have in their possession. The size, form and composition of vessel 16 are selected based on the manner in which the vessel will be connected with link 18 and make contact with living being 14. In some structures, it may be advantageous to have each vessel 16 connected to link 18 prior to placing cremated remains 12 into the vessel. In other structures, it may be advantageous to have vessel 16 prepared with cremated remains 12 already in the vessel prior to connecting with link 18. Vessel 16 maybe fabricated out of at least one from the group including wood, plastic, metal, ceramic, glass, organics, composites and a composite material including the remains. Link 18 is preferably a flexible elongated link and maybe fabricated out of at least one from the group including a cord, a cord composed of natural fiber, a cord composed of man made fiber, a rope, a wire and a chain.

Figure 2A:
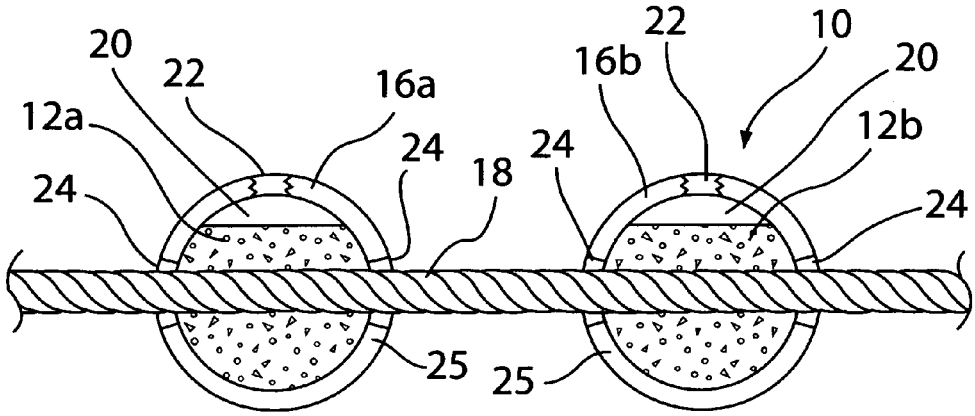
FIG. 2*a* is a sectional view of one embodiment of the structure in FIG. 1*a* illustrating the link passing through the vessels and making contact with the cremated remains.
Figure 2B:
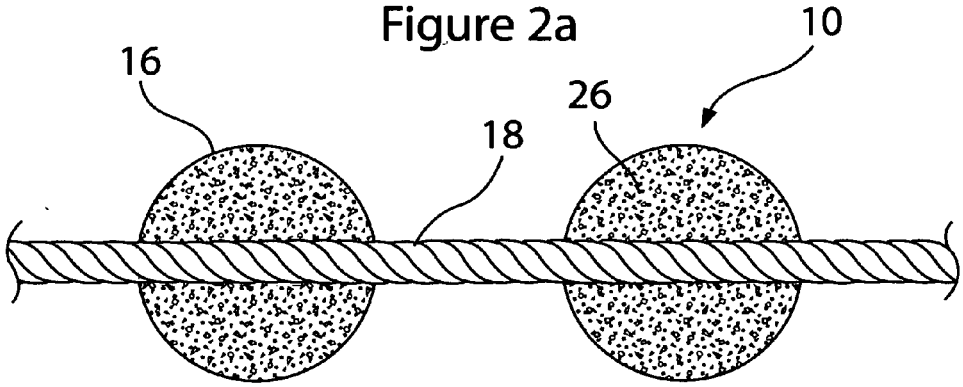
FIG. 2*b* is a sectional view of another embodiment of the structure in FIG. 1*a* illustrating the link passing through the vessels, the vessels comprised of a composite material including cremated remains.

FIGS. 2*a* and 2*b* show in more detail connecting structure 10 of FIG. 1. Connecting structure 10 comprises a first vessel 16*a*, a second vessel 16*b*, first cremated remains 12*a*, second cremated remains 12*b* and link 18. First vessel 16*a* holds first cremated remains 12*a*. Second vessel 16*b* holds second cremated remains 12*b*. Link 18 passes through both first vessel 16*a* and second vessel 16*b*. First cremated remains 12*a* and second cremated remains 12*b* both contact link 18. Link 18 thereby connects first cremated remains 12*a* with second cremated remains 12*b*. First cremated remains 12*a* and second cremated remains 12*b* are preferably from different deceased beings. Connecting structure 10 thereby can connect together the cremated remains 12 of different deceased loved ones. However, the first and second cremated remains may be from the same deceased being.

When vessels 16 are hollow vessels having an interior cavity 20 as shown in FIG. 2*a*, the vessels may further include an opening with a cap 22. The opening is used to place cremated ashes 12 into each vessel. Once ash remains 12 are placed into each vessel 16, cap 22 is used to prevent the ash remains from coming out. Cap 22 may be screwed, press fit, glued or secured by any other appropriate technique. Similarly, each vessel 16 may be fabricated as a single element having multiple connected parts that is then close upon itself to seal cremation remains 12. Vessels 16 may further have a seal 24 between vessel wall 25 and link 18. Seal 24 further prevents ash remains 12 from leaking out of each vessel. Seal 24 may be glue, epoxy, wax or a material pressed fit to create the seal. Vessels 16 may be completely filled with cremated remains 12 or partially filled with cremated remains. The goal is to have at least some cremated remains 12 in contact with link 18.

Vessels 16 may also be formed from a composite material 26 including remains 12 as shown in FIG. 2*b*. Here cremated remains 12 are mixed with a binding agent that allows the remains to be molded around link 18. Suitable binding agents might be an epoxy resin, a thermoplastic, glue, wax, etc. The ratio of binding element to ash remains 12 may vary. However, it is preferable to have a high enough concentration of cremation ashes 12 so that some of the ashes are in contact with link 18.

Figure 3:
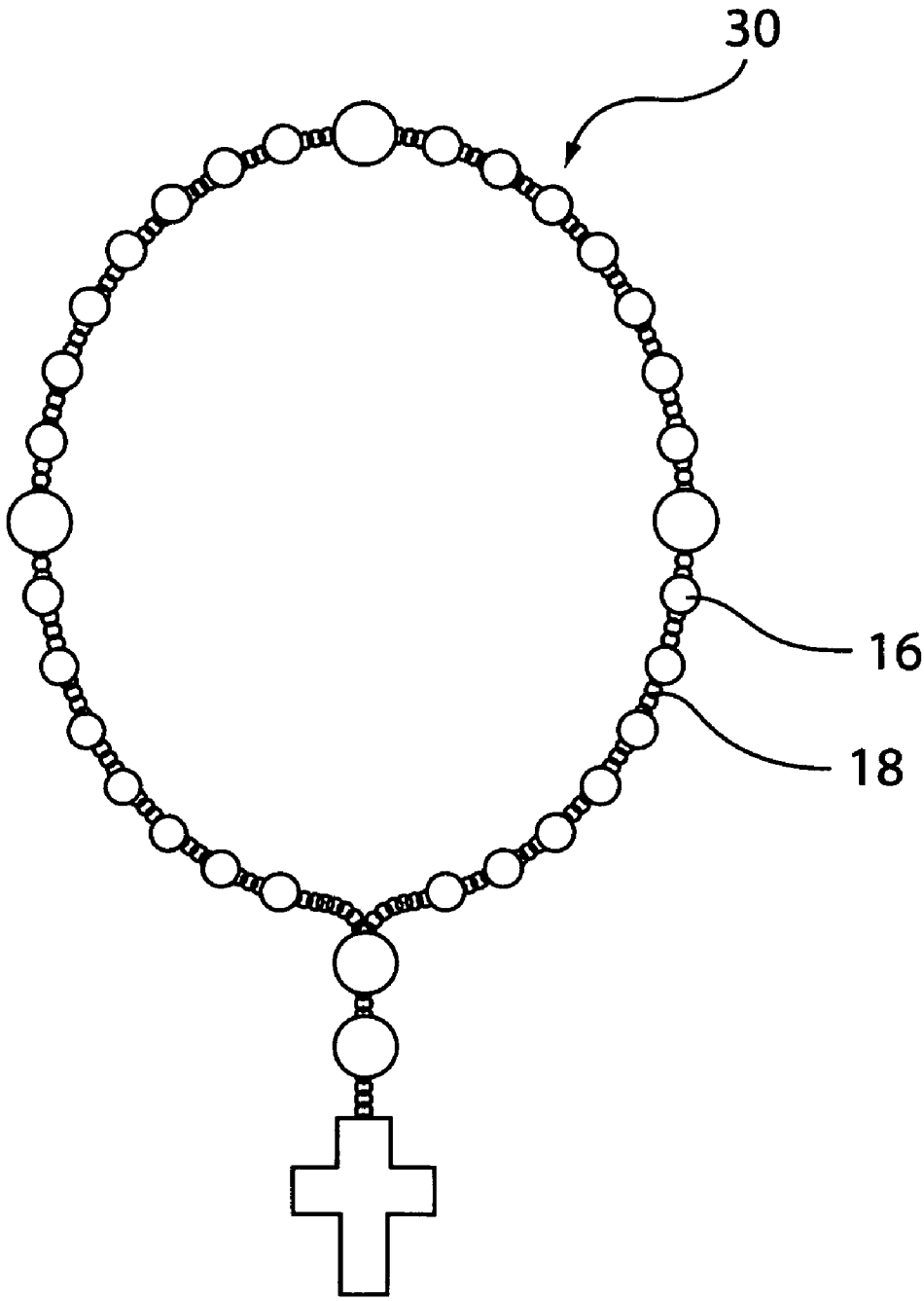
FIG. 3 is a side view of one embodiment of the present invention wherein a plurality of vessels containing cremated remains are linked together to form a set of prayer beads.

FIGS. 3 and 4*a-c* illustrate an alternative connecting structure 30. Here connecting structure 30 may take the form of a set of prayer beads as shown in FIG. 3. The prayer beads may be fabricated using a single link 18 passing through all vessels 16 as described previously. Alternatively link 18 may be a plurality of links (18=18*a*, 18*b* . . . 18*f*, etc.). Each separate link may be at least one from the group including a cord, a cord composed of a natural fiber, a cord composed of a man made fiber, a wire and a link to be used as part of a chain. Separate links are used to connect any two cremated remains 12. Separate links may also be connected to themselves as well as to cremated remains. All cremated remains 12 can be linked together in this manner. Note that each bead is a potential vessel 16 for holding cremated remains 12. Some beads may have cremated remains 12 contained within them and some may not, depending on the desired structure. A bead without cremated remains may therefore also be a link. A physical or spiritual connection is made with cremated remains 12 when a living being 14 makes contact with either links 18 or vessels 16.

Figure 4A:
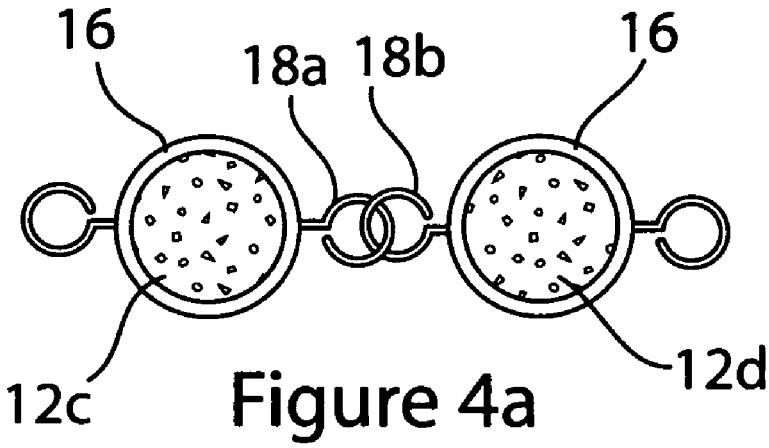
FIG. 4*a* is a sectional view of two vessels from FIG. 3 showing an embodiment wherein a first link extends from a first vessel, a second link extends from a second vessel and the first and second links join to connect the cremated remains contained within both vessels.
Figure 4B:
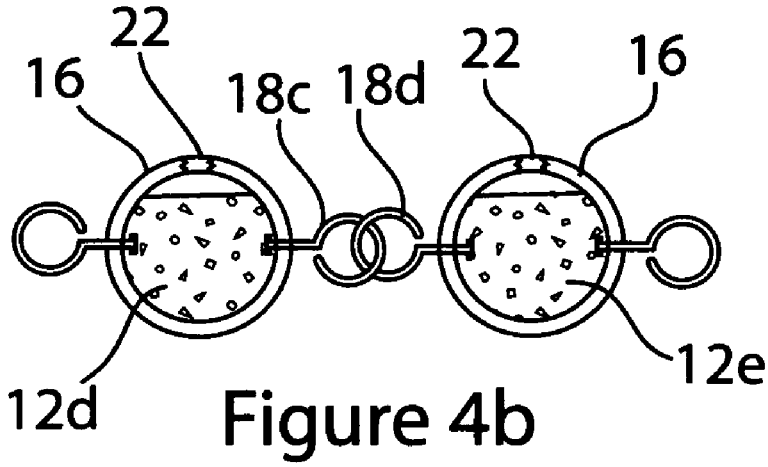
FIG. 4*b* is a sectional view of two vessels from FIG. 3 showing an embodiment wherein a first link extends from within a first vessel, a second link extends from within a second vessel and the first and second links join to connect the cremated remains contained within both vessels.
Figure 4C:
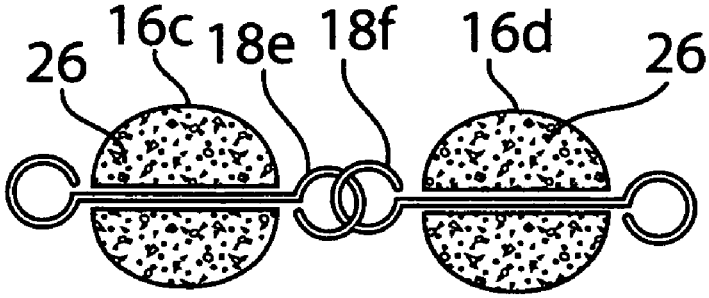
FIG. 4*c* is a sectional view of two vessels from FIG. 3 showing an embodiment wherein a first link passes through a first vessel, a second link passes through a second vessel and the first and second links join to connect the cremated remains contained within both vessels.

Links 18 may attach to vessels 16 in numerous ways. For example, link 18 may extend from vessel 16 as shown in FIG. 4*a*. Here link 18*a* and 18*b* interlock together to connect cremated remains 12*c* and 12*d* even though direct contact between the links and cremated the remains does not occur. Alternatively, link 18 may extend from within vessel 16 as shown in FIG. 4*b*. Here the portion of link 18*c* within vessel 16 contacts cremated remains 12*d*. The portion of link 18*c* external to vessel 16 connects with link 18*d*. Cremated remains 12*d* and 12*e* are connected by both links 18*c* and 18*d*. In yet another example, FIG. 4*c*, links 18*e* and 18*f* pass through vessels 16*c* and 16*d*, exiting two separate parts of the vessel. Vessels 16 in this example are beads formed from a composite material 26 including cremated remains.

Figure 5A:
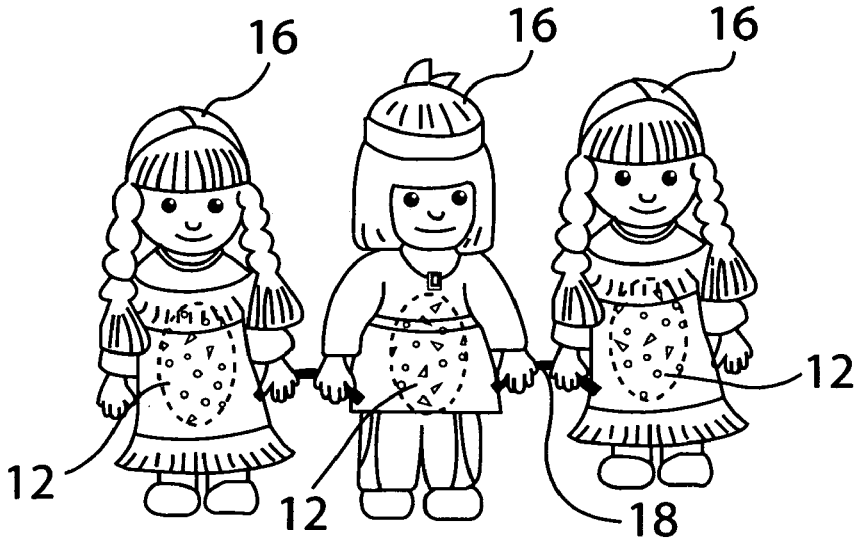
FIG. 5*a* is a side perspective view of linked vessels holding cremated remains wherein each vessel takes the form of a doll.
Figure 5B:
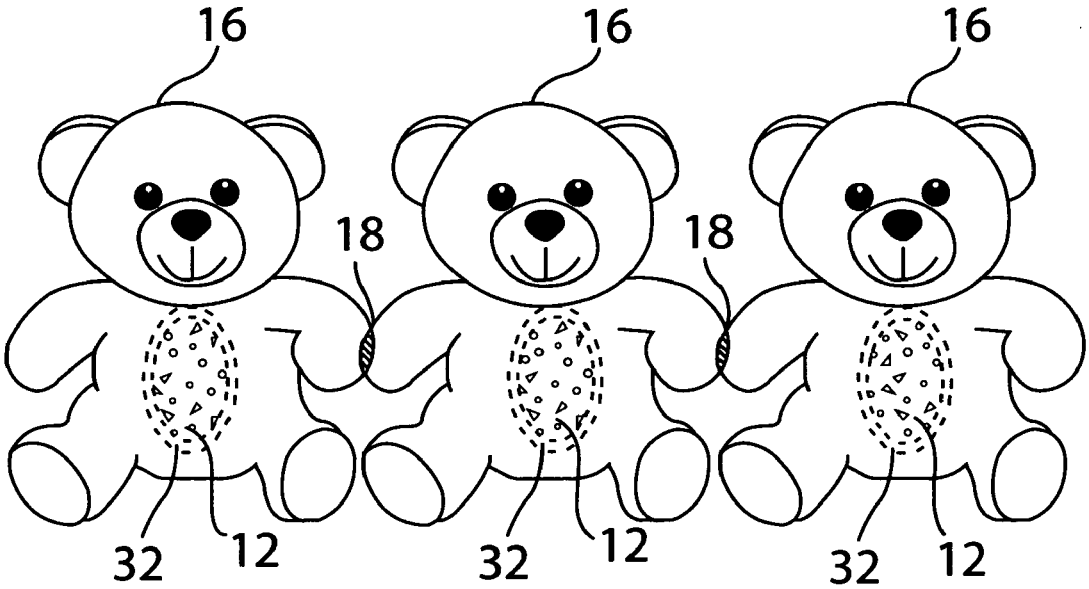
FIG. 5*b* is a side perspective view of linked vessels holding cremated remains wherein each vessel takes the form of a teddy bear.

Vessels 16 may take on many shapes and forms. FIGS. 5*a* and 5*b* illustrate some additional examples of vessels 16 for holding cremated remains 12 that may be connected together. In FIG. 5*a*, vessels 16 take the form of Indian dolls. The cremated remains 12 are held within each doll. Vessels 16 are linked together through their hands by link 18. The doll may be made in the likeness of the deceased or the likeness of a particular spirit such as a Kachina doll. In this manner vessel 16 also becomes a memorial structure for the deceased. FIG. 5*b* illustrates the vessels as teddy bears connected together by links 18 made of VELCRO®. In using vessels 16 in the form of dolls, teddy bears or similar structures it may be advantageous to further include a bag 32 for helping contain cremated remains 12.

Figure 6:
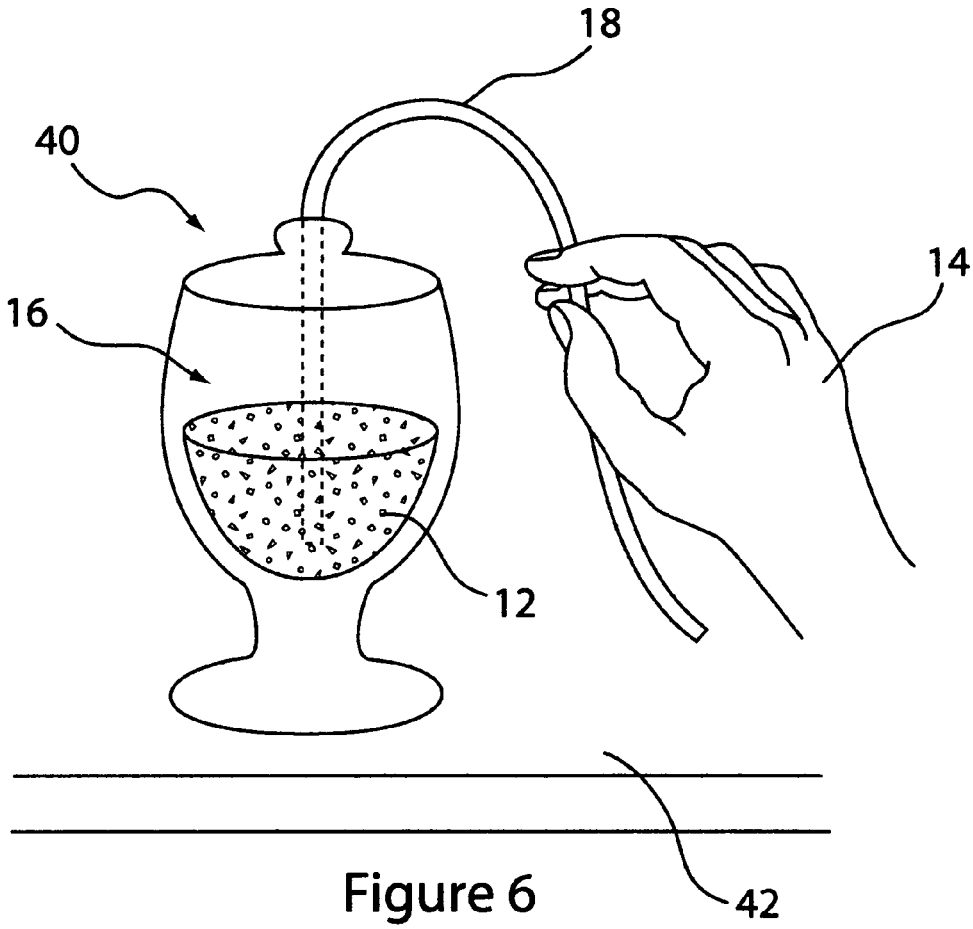
FIG. 6 is a side perspective view illustrating a connecting structure comprising a vessel in the form of an urn and an elongated flexible link, the link for connecting an individuals hand to the cremated ashes within the urn.

FIG. 6 illustrates another connecting structure 40 for facilitating the connection of cremated remains 12 with a living being 14. Connecting structure 40 comprises cremated remains 12, vessel 16 and link 18. Vessel 16 (a.k.a., urn) holds cremated remains 12 and may be placed on a table 42. Link 18 extends into vessel 16 to contact cremated remains 12. Link 18 is preferably a flexible link that has sufficient flexibility that it cannot support vessel 16 when the vessel is above the link. Living being 14 may make a physical and spiritual connection with cremated remains 12 by touching or holding link 18.

Figure 7:
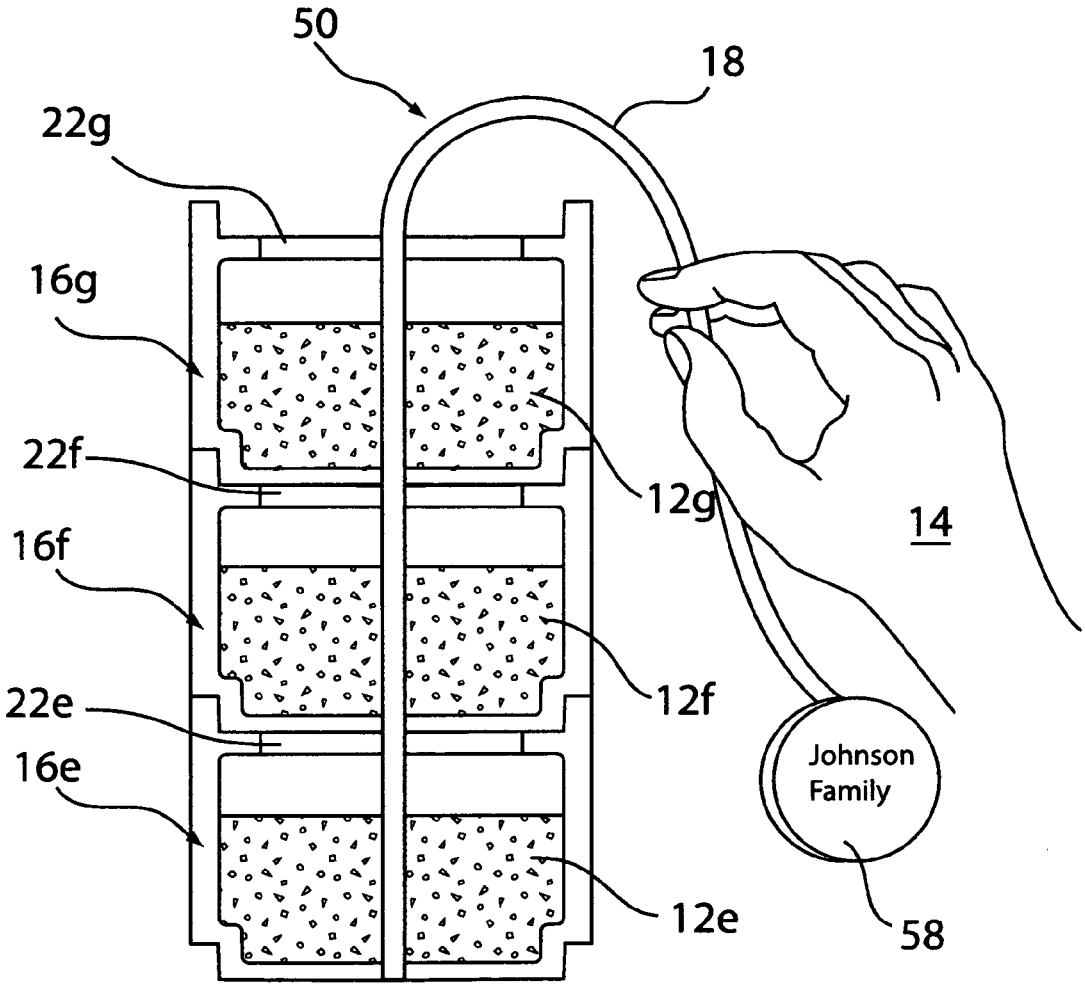
FIG. 7 is a sectional view of an embodiment of the present invention with a link passing through a plurality of stacked vessels, wherein each vessel contains cremated remains of a different family member, wherein when the link is touched by a loved one a connection is made with all of the cremated remains.

FIG. 7 illustrates yet another connecting structure 50 for facilitating the connection of cremated remains 12 with a living being 14. Connecting structure 50 comprises a plurality of cremated remains 12, a plurality of vessels 16 and link 18. Link 18 is preferably a flexible elongated link. Each vessel 16 has a cap 22 to aid in containing cremated remains 12. Vessels 16*e-g* are shaped to stack together to create one larger structure with different cremated remains 12 contained in each vessel. For the first vessel 16*e*, link 18 is secured to the base. Link 18 may pass through the base or extend from it. Link 18 then passes through the inner portion of vessel 16*e* contacting cremated remains 12*e*. Link 18 exits through cap 22*e*. With only one vessel 16, connecting structure 50 is similar to connecting structure 40 shown in FIG. 6. The living being may connect to cremated remains 16*e* by contacting link 18. If another loved one dies, a second vessel 16*f* containing cremated remains 12*f* may be added to connecting structure 50. Link 18 is threaded through the base of vessel 16*f* to contact cremated remains 12*f* and exit through cap 22*f*. If yet another loved one dies, a third vessel 16*g* containing cremated remains 12*g* may be added to connecting structure 50. Link 18 is threaded through the base of vessel 16*g* to contact cremated remains 12*g* and exit through cap 22*g*. As many remains as one wants may be connected together in this manner. The resulting connecting structure 50 provides a way to connect multiple cremated remains 12 with each other and with a living being when the living being contacts link 18. Various structures such as a small memorial plaque 58 may also be connected to link 18.

Figure 8A:
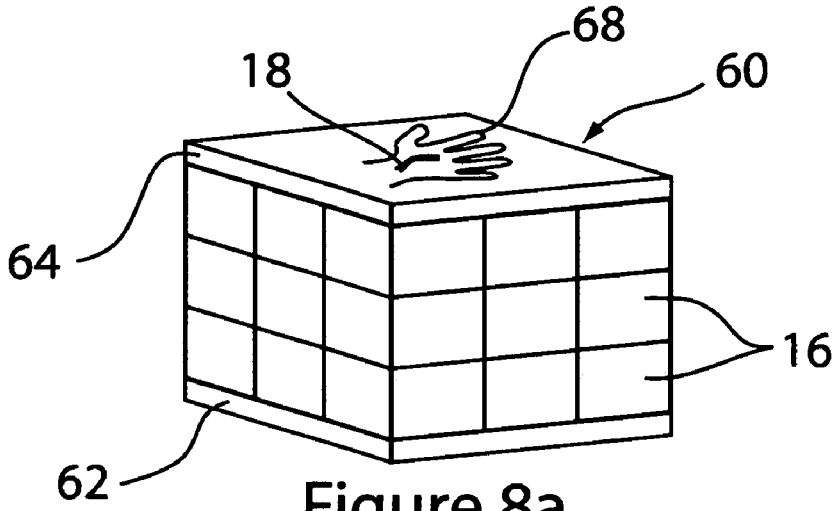
FIG. 8*a* is a perspective view of an embodiment of the present invention where a plurality of vessels containing cremated remains are stacked in a 3-dimensional structure, wherein a link passes through each vessel and exits into a depression, a connection is made with all of the deceased remains when a loved one places their hand in the depression.
Figure 8B:
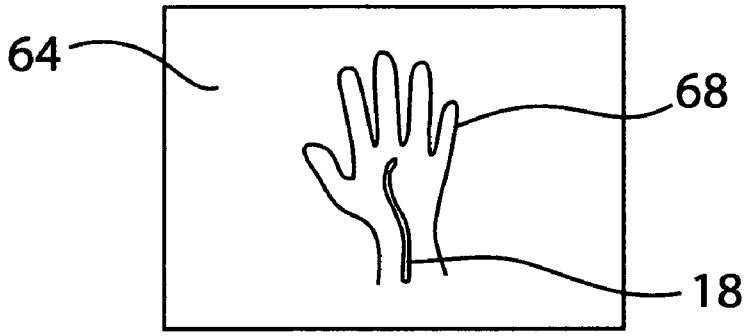
FIG. 8*b* is a plan view of the top of the structure in FIG. 8*a* showing the link residing within the depression, the depression is an impression in the shape of a human hand.
Figure 8C:
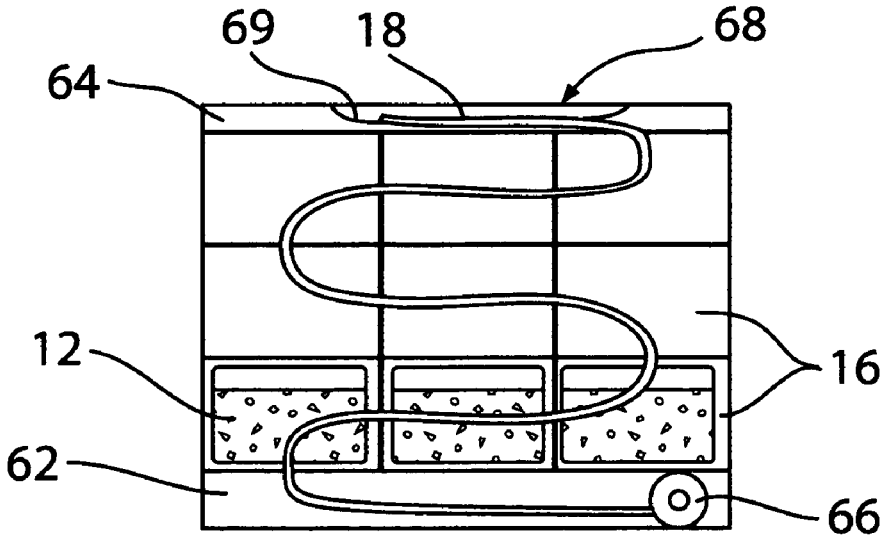
FIG. 8*c* is a side, sectional view of the structure in FIG. 8*a* showing a flexible cord linking the cremated remains.

FIGS. 8*a-c* illustrate still another connecting structure 60 according the present invention. Structure 60 is a 3-dimensional structure comprising a plurality of vessels 16 and a link 18. Each vessel 16 may contain cremated remains 12. Structure 60 further includes a base 62 and a top plate 64. Structure 60 may further include side walls (not shown) that house all vessels 16. Base 62 houses a mechanism 66 for extending a quantity of flexible link 18. As each loved one dies, a quantity of link 18 is threaded through an empty vessel 16 and cremated remains 12 are placed within the empty vessel. Not all vessels 16 have to contain cremated remains or link 18. Vessels 16 are stacked to produce a 3-dimensional structure. The height of connecting structure 60 is determined by the number of layers of vessels 16 it is built from. The free end of link 18 is threaded through top plate 64. Within top plate 64 may be formed an impression 68 of a human hand (a.k.a., inverted hand). Link 18 lies along the surface 69 within impression 68. A living person may then place their hand in impression 68 to make contact with link 18 and connect physically and spiritually with the deceased's remains. Connecting structure 60 may also take on the shape of other 3-dimensional structures, for example a pyramid or a sphere. The vessels would either be housed within the walls of such 3-dimensional structure or each vessel would possess a shape so that when stacked the combination of vessels creates the 3-dimensional structure.

Figure 9:
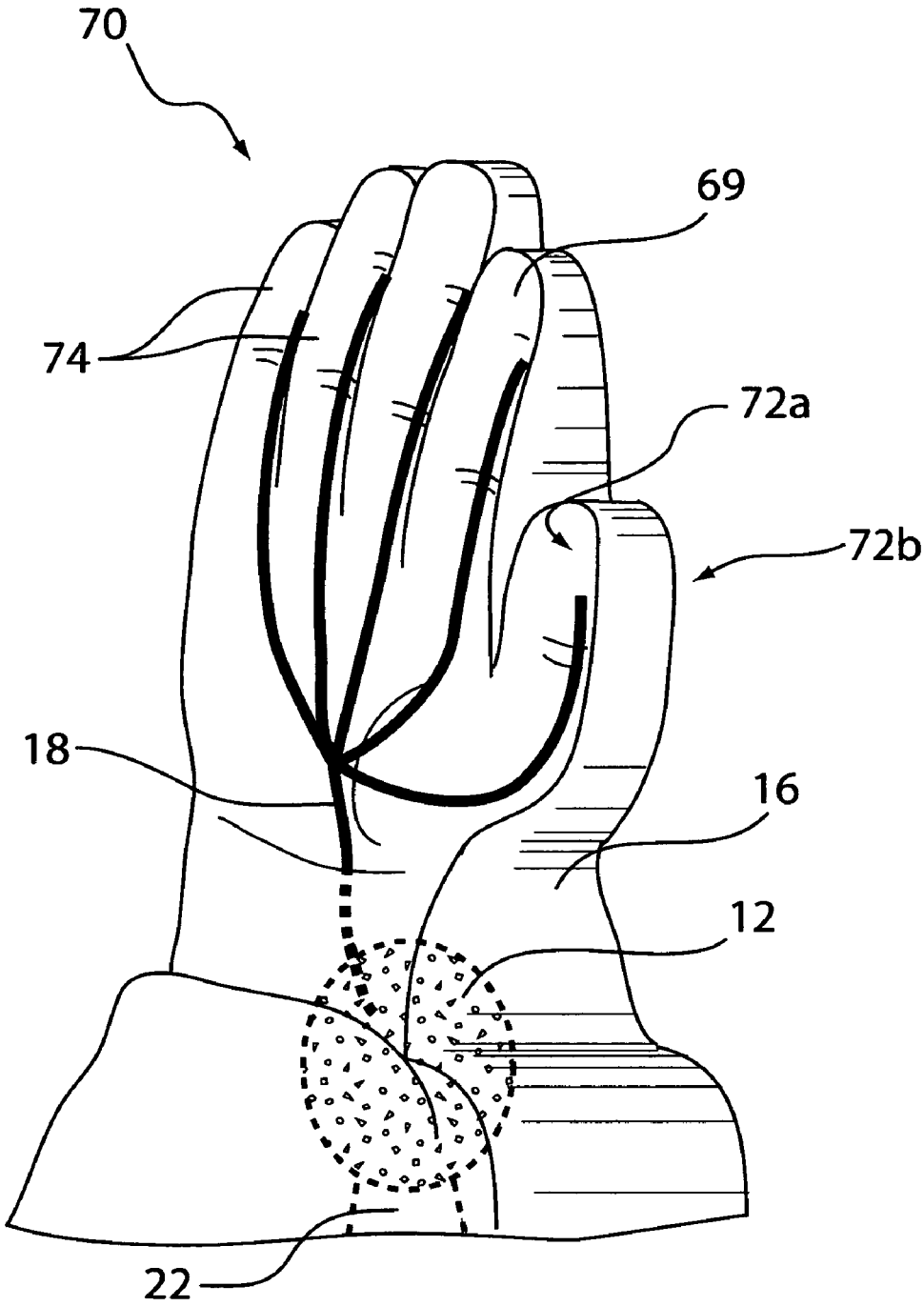
FIG. 9 is a perspective view of an embodiment of the present invention where a vessel containing cremated remains is provided in the shape of a pair of hands, wherein a link passes through the cremated remains and connects with the surface of the hands.

FIG. 9 illustrates still another connecting structure 70 for facilitating the connection of cremated remains 12 with a living being. Connecting structure 70 comprises cremated remains 12, vessel 16 and link 18. Vessel 16 takes the shape of a pair of inverted hands 72*a* and 72*b* connected together as a single structure. Inverted finger impressions 74 are formed within pair of inverted hands 72. Link 18 makes contact with cremated remains 12 and then extends outward to lie along surface 69 of vessel 16 with finger impressions 74. A living being may make a physical and spiritual connection with cremated remains 12 by placing their hands within finger impressions 74 and touching link 18. Inverted hands 72 may also be placed on top of a separate vessel or plurality of vessels similar to those depicted in FIGS. 7 and 8*a* that contain cremated remains 12. In this variation of the invention the link would extend from the cremated remains in the vessel or vessels to the surface of the finger impressions.

Figure 10A:
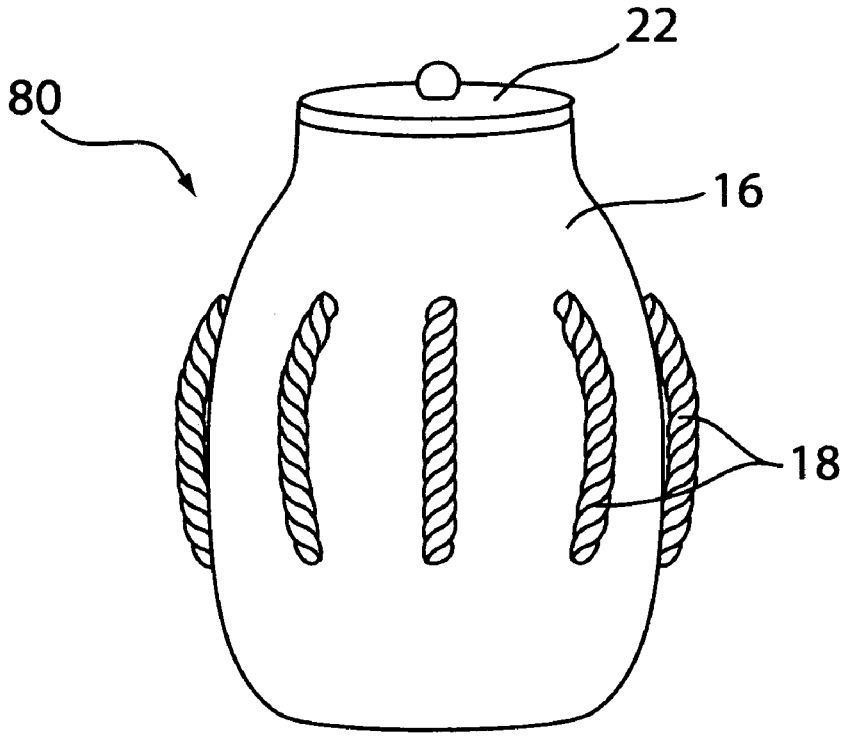
FIG. 10*a* is a side perspective view of another embodiment of the present invention showing a plurality of links lying along the outer surface of a vessel containing cremated remains.
Figure 10B:
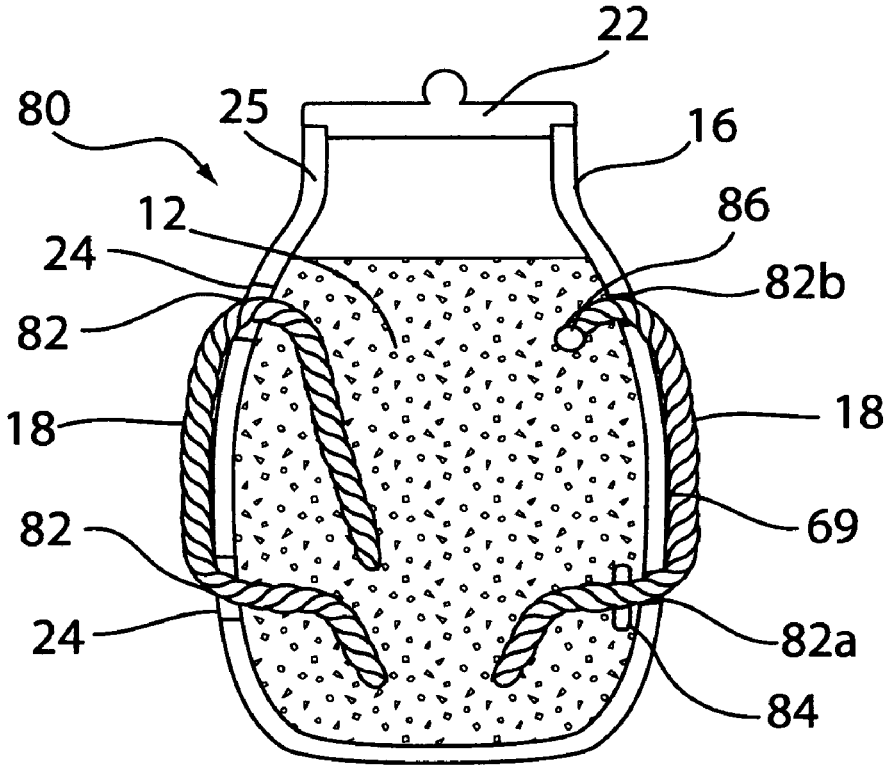
FIG. 10*b* is a side sectional view of the vessel in FIG. 10*a* showing how two of the links lie along the outer surface of the vessel and pass through the vessel wall to contact the cremated remains.

FIGS. 10*a* and 10*b* illustrate still another connecting structure 80 for facilitating the connection of cremated remains 12 with a living being. Connecting structure 80 comprises cremated remains 12, vessel 16, link 18 and cap 22. Vessel 16 contains cremated remains 16. One or more links 18 are arranged so that link 18 contacts cremated remains 12 and a portion of the link lies along the outer surface 69 of vessel 16. Link 18 may be threaded through holes 82 in side wall 25 of vessel 16. Vessel 16 may further have seal 24 between vessel wall 25 and link 18 to prevent cremated remains 12 from leaking out. Fasteners 84 may also be used to help secure link 18 to stop the link from being pulled out of vessel 16. FIG. 10*b* shows two examples of links according to this embodiment. In the first example, link 18 has two ends both of which pass through holes 82 and make contact with cremated remains 12. Seal 24 is used to stop cremated remains 12 from leaking out. In the second example, link 18 has one end passing through hole 82*a*, this end makes contact with cremated remains 12 and is secured by fastener 84. The portion of the link 18 outside vessel 16 lies along the outer surface 69 of the vessel. The other end 86 of link 18 then passes back into the vessel through hole 82*b*. End 86 may then run internal to vessel 16 and come out another hole 82. In this manner link 18 may be threaded in and out of vessel 16. A living being may place their hands on the portions of link 18 outside vessel 16 to make a physical and spiritual connection with the remains inside. A memorializing structure such as a ring worn by the deceased may also be attached to the portion of the link outside the vessel.

Figure 11A:
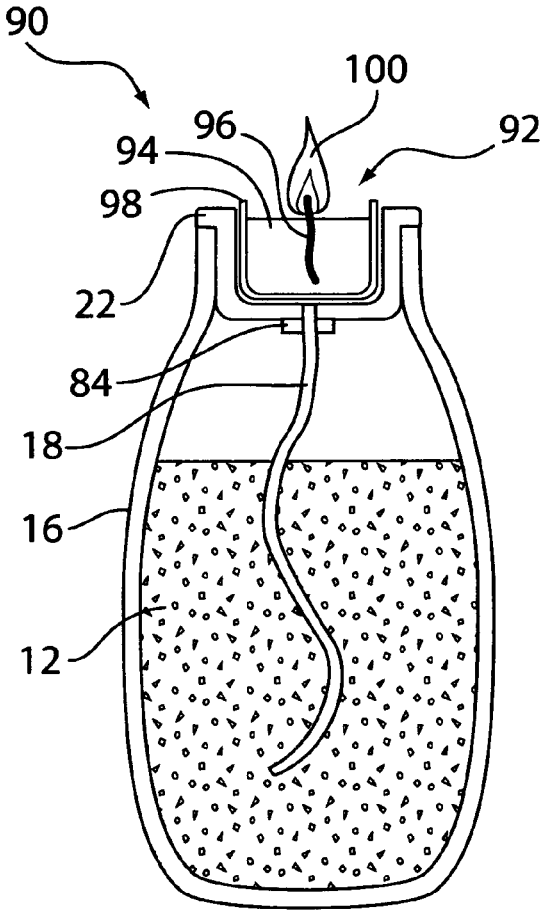
FIG. 11*a* is a side sectional view of yet another embodiment of the present invention where a vessel containing cremated remains also holds a candle, the candle and remains are connected by a link.
Figure 11B:
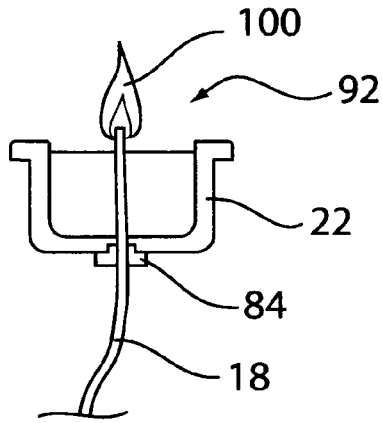
FIG. 11*b* is a side sectional view showing an alternative connection means between the link and candle of FIG. 11*a*, here the link becomes the wick of the candle.

FIGS. 11*a* and 11*b* illustrate still yet another connecting structure 90 for facilitating the connection of cremated remains with a candle. Connecting structure 90 comprises cremated remains 12, vessel 16, link 18, cap 22 and candle 92. Vessel 16 contains cremated remains 12. Vessel 16 holds candle 92. Candle 92 may be fabricated from wax 94, a wick 96 and a containment structure 98. Link 18 contacts cremated remains 12 and extends outside vessel 16. In FIG. 11*a*, link 18 extends out of vessel 16 through cap 22 and is secured with fastener 84 to the cap. The base of candle 92 contacts link 18. Link 18 may also lie along an outer surface of vessel 16 to make contact with candle 92. FIG. 11*b* shows and alternative candle structure where cap 22 is the containment structure for candle 92 and link 18 becomes the wick. Fastener 84 acts to stop liquid wax from flowing into vessel 16 and also stops flame 100 from entering the vessel.

The invention is not limited to the embodiments represented and described above but includes all variants notably those concerning the type and shape of vessels used, and the manner in which the vessels are linked or connect with a living being. Nothing in the above specification is intended to limit the invention more narrowly than the appended claims. The examples given are intended only to be illustrative rather than exclusive.

What is claimed is:

1. A structure for connecting with cremated remains, comprising:

a vessel having an interior containing said cremated remains and a flexible elongated link, wherein said link is in contact with said remains and a portion of said link extends to and lies along an exterior outer surface of said vessel, and wherein said link is at least one from the group including a flexible cord composed of natural fiber, a flexible cord composed of man made fiber, a rope, and a chain.

2. A structure as recited in claim 1, wherein said link has first and second ends.

3. A structure as recited in claim 2, wherein said first end and said second end of said link are within said interior of said vessel.

4. A structure as recited in claim 1, wherein said exterior outer surface includes an impression of an inverted hand.

5. A structure as recited in claim 4, wherein said link extends from said cremated remains to within said impression of an inverted hand.

6. A structure as recited in claim 5, wherein said link lies within at least one finger impression of said impression of an inverted hand.

7. A structure as recited in claim 1, wherein said vessel is in the shape of a pair of inverted praying hands.

8. A structure as recited in claim 1, wherein said link is for contact with a living being.

9. A structure for connecting with cremated remains, comprising:

a link and a vessel having an interior and an exterior outer surface, wherein said vessel contains said cremated remains in said interior, wherein said vessel includes at least one impression of an inverted hand on said exterior outer surface, wherein said link contacts and extends from said cremated remains to lie along said exterior outer surface within said impression, and whereby when a person places their hand within said impression a physical and spiritual connection is capable of being made between the person and said remains through said link.

10. A structure as recited in claim 9, wherein said link lies within at least one finger impression of said at least one impression of said inverted hand.

11. A structure as recited in claim 9, wherein said link splits into a plurality of links on said exterior outer surface.

12. A structure as recited in claim 9, wherein said vessel has a pair of said impressions of an inverted hand.

13. A structure as recited in claim 12, wherein said pair of said impressions of an inverted hand are positioned opposite each other to facilitate prayer.

14. A structure for connecting with cremated remains, comprising:

a plurality of vessels and a link;

wherein said vessels are stacked to form a 3-dimensional structure;

wherein said link runs through each said vessel;

wherein at least one said vessels contains said cremated remains in an interior thereof; and wherein said link contacts and extends from said cremated remains to an exterior outer surface of said 3-dimensional structure.

15. A structure as recited in claim 14, wherein said exterior outer surface includes at least one impression of an inverted hand.

16. A structure as recited in claim 15, wherein said link lies within said at least one impression of an inverted hand.

* * * * *